United States Patent [19]

Miller et al.

[11] Patent Number: 4,547,756

[45] Date of Patent: Oct. 15, 1985

[54] MULTIPLE REED SWITCH MODULE

[75] Inventors: Norbert D. Miller, Jefferson; Craig V. LaFleur, Lake Mills, both of Wis.

[73] Assignee: Hamlin, Inc., Lake Mills, Wis.

[21] Appl. No.: 554,444

[22] Filed: Nov. 22, 1983

[51] Int. Cl.[4] ..... H01H 1/66

[52] U.S. Cl. ..... 335/152; 335/159; 335/162

[58] Field of Search ..... 335/151, 152, 153, 154, 335/159, 162

[56] References Cited

U.S. PATENT DOCUMENTS

| | | | |
|---|---|---|---|
| 3,086,085 | 4/1963 | Palm | 335/152 |
| 3,760,311 | 9/1973 | Zimet et al. | 335/152 |
| 3,940,722 | 2/1976 | Fox et al. | 335/151 |
| 4,177,439 | 12/1979 | Smith | 335/151 |

FOREIGN PATENT DOCUMENTS

| | | | |
|---|---|---|---|
| 1573610 | 8/1980 | United Kingdom | 335/151 |

*Primary Examiner*—George Harris

*Attorney, Agent, or Firm*—Isaksen, Lathrop, Esch, Hart & Clark

[57] ABSTRACT

A multiple reed switch module includes multiple reed switches aligned in fixed, spacial relation by thermoplastic side rails attached to the switch leads, with lead ends extending perpendicularly from the leads in parallel relation. The side rails function as a spacing mechanism and facilitate handling of the switches, and the efficient insertion of the multiple parallel lead ends in circuit board assemblies.

8 Claims, 2 Drawing Figures

MULTIPLE REED SWITCH MODULE

BACKGROUND OF THE INVENTION

1. Field of the Invention

The present invention relates to the placement of reed switches on circuit boards, and in particular means for facilitating high speed, accurate insertion of multiple reed switches in circuit board assemblies.

2. Description of the Prior Art

The prior art is generally cognizant of circuit board assemblies wherein multiple conventional glass enclosed reed switches are mounted in closely spaced, parallel relation on circuit boards. The glass envelopes of the switches extend generally parallel to the circuit boards and the leads from the opposed ends of the switch envelopes are bent at right angles and extend normally into the circuit board to engage terminal sockets formed therein. Conventionally, such switch leads are inserted manually into the circuit boards by production workers, one switch at a time, care being required to insure that the switches are accurately located with respect to each other and to the circuit board. Because of the high labor costs associated with such manual methods, automated insertion equipment is sometimes utilized, where the volume of assemblies can justify the considerable capital cost of such equipment and set-up requirements. However, where such equipment is not available or practical, it has been necessary for industry to continue costly one-at-a-time, manual methods.

SUMMARY OF THE INVENTION

The present invention is summarized as a multiple reed switch module which is designed to be inserted into a conventional printed circuit board or a conventional terminal socket mounted on a printed circuit board. The multiple reed switch module contains magnetically actuated reed switches which each have a body, two leads extending linearly from the body, and lead ends which are perpendicular to the linear axis of the leads. A multiplicity of reed switches are held parallel to each other and at a uniform distance from each other by two side rails attached to the leads and lead ends which extend from either side of the reed switch bodies.

It is an object of the present invention to provide a multiple reed switch module composed of any desired number of reed switches having leads and lead ends secured within non-conductive side rails to positively locate the switches and the lead ends with respect to each other to facilitate high speed insertion of the lead ends in circuit board assemblies without the need for costly automated insertion equipment.

It is a further object of the present invention to provide a rigid configuration which will give stress relief to the reed switches while the multiple reed switch module is being handled, inserted and used in the printed circuit board.

It is still further an object of the present invention to closely control the location of the reed switch bodies relative to each other in order to provide predictable operating characteristics for the multiple reed switch module within a circuit board assembly.

Other objects, advantages and features of the present invention will become apparent from the following detailed specification when taken in conjunction with the accompanying drawings.

DESCRIPTION OF THE PREFERRED EMBODIMENT

Figure 1:
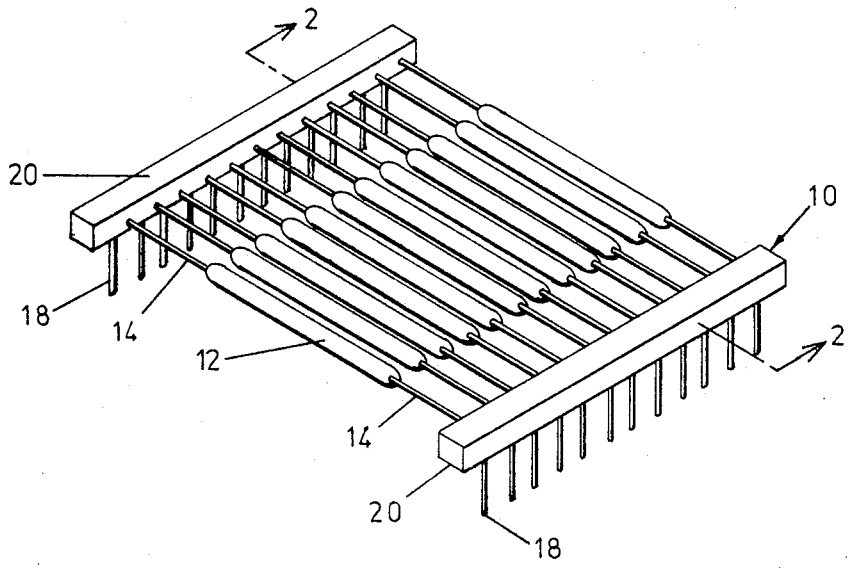
FIG. 1 is a perspective view of a multiple reed switch module constructed according to the present invention.

FIG. 1 shows a preferred multiple reed switch module 10 constructed in accordance with the present invention. The reed switch module 10 includes a substantial number of conventional reed switches 12, each having a pair of axially extending leads 14 with perpendicularly extending lead ends 18, and secured in fixed relation to each other by a pair of rails 20 molded to the leads 14 and lead ends 18 in perpendicular relation to the switches 12. The module 10 may include any practical number of reed switches 12 which are desired to be used in closely associated position in a common plane on a circuit board assembly (not shown).

Preferably, but not necessarily, the reed switches 12 are associated within the module 10 in uniformly spaced, parallel position. The two leads 14 of each switch 12 extend from the switch in opposite directions along the axis 16 of the switch. The lead ends 18 of the two leads 14 extend perpendicularly to the leads 14 in co-planar, parallel relation. The side rails 20 are preferably molded around both the leads 14 and the lead ends 18. Accordingly, the leads 14 and connected reed switches 12, are positively secured by the rails 20 in fixed position with respect to each other. The lead ends 18 are also positively located by the rails 20 in a fixed pattern to correspond with the spacing of circuit board openings or conductive sockets mounted on the particular circuit boards for which the module 10 is designed. For example, a common conventional circuit board may have openings every one-eighth inch, and the module 10 would accordingly be constructed wih one-eighth inch center-to-center spacing of the lead ends 18 extending from each side rail 20. Correspondingly, the center-to-center distance between the opposed lead ends 18 of each reed switch 12 in the module 10 would be a multiple of one-eighth inch or other required dimension to match the board spacing or the sockets. It is thus apparent that all of the reed switches 12 of the module 10 may be inserted in the circuit board, in closely controlled relative position, by the simple act of orienting the lead ends 18 of the module properly over the circuit board and pressing on the side rails 20 to urge the lead ends 18 into the identically spaced associated openings or sockets of the circuit board.

Figure 2:
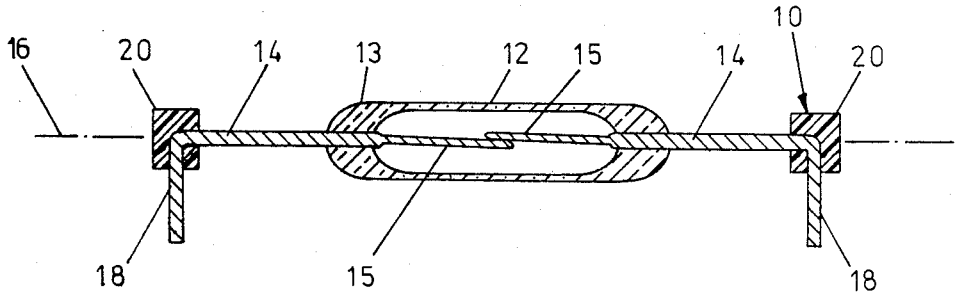
FIG. 2 is an enlarged section view taken along section line 2—2 of FIG. 1.

FIG. 2 best illustrates an ordinary reed switch 12 of the type preferred for use in this invention. As previously discussed, the reed switch 12 includes two leads 14, and a glass body 13 enclosing the ends of the leads 14 in hermetically sealed relation. The two leads 14 extend generally along the switch axis 16 where the free ends of the leads are slightly overlapping within the glass body 13. Each lead 14 may be made of a single metallic material formed from wire stock having the desired conductivity and magnetic characteristics. The overlapping ends of the leads 14 are flattened into a rectangular elongated shape or "reed" 15. The rectangular elongated shape of the reed 15 serves to insure a good electrical contact and magnetical response during operation of the switch between "on", when the reeds 15 are in contact and conducting, and "off" when the reeds are separated and non-conducting.

It can also be seen from FIG. 2 that the lead end 18 extending from each lead 14 remains in its original wire form. The two lead ends 18 are preferably formed by bending the leads 14 90° from the switch axis 16 in co-planar, parallel relation. Although the glass bodies 13 and enclosed reeds 15 of switches 12 are positioned an equal distance from the associated lead ends 18 in module 10, which is preferred, the switches 12 could be positioned anywhere between the side rails 20 depending upon the desired configuration of the circuit board assembly (not shown). Accordingly the length of the leads 14 and the location of the 90° bends and lead ends 18 will be dependent upon the desired position of the associated switch 12 within the module 10. In any event, the 90° orientation of the lead ends 18 facilitates insertion of the reed switches 12 into standard printed circuit boards and sockets.

The tubular glass body 13 of the switch 12 is molded to the leads 14 to hermetically seal the environment of the reeds 15, as previously indicated. The glass body 13 also structurally retains the leads 14 in the desired opposed position, and insulates the leads 14 from each other as well as the other circuit board components in a conventional manner.

The two side rails 20 of each multiple reed switch module 10 are preferably aligned parallel to each other and perpendicular to the switch axes 16. The side rails may be made of any electrically non-conductive thermoplastic material of sufficient strength and rigidity to structurally connect and suppport the reed switches 12 within the module 10 in all expected handling, assembly and use conditions. The non-conductive material insures the electrical independence of each switch with respect to the other switches. The shape of the side rails is not critical, so long as the side rails substantially engage the leads 14 and lead ends 18; however, the elongated rectangular box form having four elongated sides and square ends is preferred for simplicity and manufacturing efficiency. The side rails 20, as illustrated in FIG. 1, are preferably molded directly to the leads 14 and lead ends 18 where the leads 14 are bent 90° downward, as best shown in FIG. 2. At that location, a side rail of minimum cross-sectional area can engage both the axial lead 14 and the perpendicular lead end 18 for a substantial distance, as shown. Such engagement provides stability to both the lead 14 and connected switch 12 within the module 10, and the downwardly depending lead ends 18 extending from the module. It is preferable that the lead ends 18 be so engaged and stabilized to minimize bending of the lead ends 18 in handling and assembly, which would cause the lead ends to become misaligned with the sockets of the circuit boards (not shown), and require straightening before assembly.

In use, the present invention improves the handling and assembly of multiple reed switches onto circuit boards, and inspection of multiple reed switches. The side rails 20 also function to hold the reed switches in precise relative position within the module, and insure more precise alignment of the switches 20 within the array than that which would be afforded by the circuit board openings alone. This characteristic permits use of multiple reed switch arrays with more predictable operation of the precisely positioned switches in response to magnetic actuators. The side rails 20 facilitate assembly and inspection of multiple reed switches on printed circuit boards by eliminating the need to separately place each reed switch required for the circuit onto the board in precise position relative to other reed switches within an array, and facilitating inspection of the array by reference to the integrity of the module 10 rather than one-by-one inspection and adjustment of the reed switches and connected leads. Inspection of the individual reed switches 12 in the module 10 is not hindered by the side rails 20. The side rails do not block view of the reed switch contacts before or during assembly or operation of the modules on printed circuit boards.

Another advantage of the invention is that the module 10 secures the multiple associated reed switches in a desired uniform, rigid and manageable size. In this form the modules 10 are easily picked up and moved by engagement of the side rails 20, without touching the more fragile switches 12, leads 14 and lead ends 18. This advantage facilitates the handling and maneuvering of the module both prior to and during assembly onto printed circuit boards. In addition, the reed switches 12 are more easily inventoried when fixedly engaged in known multiples within the modules 10.

In manufacture of the modules 10, any convenient number of twin lead reed switches of any size or characteristics may be molded within side rails 20 of any appropriate length in any desired spaced relation. The opposed side rails 20 may then be cut where appropriate to provide modules 10 of desired length and number of switches. It can be seen that the module 10 can be economically manufactured with a minimum of relatively low cost thermoplastic material. Accordingly, use of the module of the invention can be cost effective whenever it is desired to mount a substantial number (perhaps six or more) of reed switches in closely spaced relation within a circuit board assembly.

It is to be understood that the present invention is not limited to the particular construction and arrangement of parts illustrated herein, but embodies all such modified forms thereof as come within the scope of the following claims.

We claim:

1. A multiple reed switch module comprising:

(a) a plurality of sealed reed switches, each reed switch having a body, two leads extending linearly outward from the body, and lead ends which are parallel to each other, but perpendicular to the linear axis of the leads;

(b) two electrically non-conductive side rails which hold the reed switches in fixed spacial relation and orientation to each other, the first side rail attached to the leads which extend from one side of the reed switch bodies, and the second side rail attached to the leads which extend from the other side of the reed switch bodies, so that together the reed switches and the side rails form a singular module which can be inserted into, and removed from, a socket mounted on a printed circuit board, the reed switch bodies in the module being separated from the side rails and fully exposed for inspection and access during insertion and operation of the module on a printed circuit board.

2. A multiple reed switch module as recited in claim 1 in which the reed switches are positioned in parallel relation.

3. A multiple reed switch module as recited in claim 1 in which the side rails are molded around the leads.

4. A multiple reed switch module as recited in claim 3 in which the molded side rails are made from a synthetic resin.

5. A multiple reed switch module comprising:

(a) a plurality of sealed reed switches, each reed switch having a glass body, two leads extending linearly outward from the body, and lead ends which are parallel to each other, but perpendicular to the linear axis of the leads;

(b) two electrical non-conductive side rails which hold the reed switches in fixed, spacial relation to each other with the lead ends all pointing in the same direction, the first side rail attached in such a manner that the attachment includes both a portion of the lead ends and a portion of the leads which extend from one side of the reed switch bodies, and the second side rail attached in such a manner that the attachment includes both a portion of the lead ends and a portion of the leads which extend from the other side of the reed switch bodies, so that together the reed switches and the side rails form a single module which can be inserted into, and removed from, a socket mounted on a printed circuit board.

6. A multiple reed switch module as recited in claim 5 in which the side rails are molded around a portion of the lead ends and a portion of the leads.

7. A multiple reed switch module as recited in claim 6 in which the molded side rails are made from a synthetic resin.

8. A multiple reed switch module as recited in claim 6 in which the reed switches are positioned in parallel relation.

* * * * *